US008744107B2

(12) United States Patent
Meister et al.

(10) Patent No.: US 8,744,107 B2
(45) Date of Patent: Jun. 3, 2014

(54) HEARING DEVICE WITH REDUCED ACOUSTIC WIND SENSITIVITY

(75) Inventors: Bernd Meister, Erlangen (DE); Hartmut Ritter, Neunkirchen am Brand (DE); Christian Weistenhöfer, Bubenreuth (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 18 days.

(21) Appl. No.: 13/437,050

(22) Filed: Apr. 2, 2012

(65) Prior Publication Data

US 2012/0250921 A1 Oct. 4, 2012

(30) Foreign Application Priority Data

Mar. 31, 2011 (DE) ..... 10 2011 006 563

(51) Int. Cl.
*H04R 25/00* (2006.01)

(52) U.S. Cl.
USPC ..... 381/330; 381/312; 381/322

(58) Field of Classification Search
USPC ..... 381/312–331, 359; 181/130
See application file for complete search history.

(56) References Cited

U.S. PATENT DOCUMENTS 4,869,339 A * 9/1989 Barton ..... 181/130
2002/0085729 A1 7/2002 Marx
2003/0044035 A1* 3/2003 Masters et al. ..... 381/322

FOREIGN PATENT DOCUMENTS

DE 10351247 A1 6/2005
WO 2004091998 A1 10/2004

OTHER PUBLICATIONS

Fraunhofer Mediendienst, "Haifischhaut Fuer Flugzeuge, Schiffe Und Windenergieanlagen", May 2010, Fraunhofer-Gesellschaft, Muenchen.
Fraunhofer, "A sharkskin for aircaft, ships and wind turbines", Media Service, Special Edition May 2010, Topic 4, Fraubhofer-Gesellschaft, Munich, Book, 2010.
Fraunhofer-Institut für Bauphysik, "Umweltfreundlich and wirtschaftlich in die Luft gehen", Mar. 30, 2011, XP002679173, found in the internet: URL:http://www.fraunhofer.de/ on Jul. 2, 2012, p. 2 last paragraph, p. 3 first pararaph—Statement of Relevance.

* cited by examiner

*Primary Examiner* — Matthew Eason
(74) *Attorney, Agent, or Firm* — Laurence A. Greenberg; Werner H. Stemer; Ralph E. Locher

(57) ABSTRACT

A hearing device has reduced acoustic wind sensitivity. For that purpose, the hearing device has a surface formed with a shark skin structure.

9 Claims, 3 Drawing Sheets

HEARING DEVICE WITH REDUCED ACOUSTIC WIND SENSITIVITY

CROSS-REFERENCE TO RELATED APPLICATION

This application claims the priority, under 35 U.S.C. §119, of German patent application DE 10 2011 006 563.6, filed Mar. 31, 2011; the prior application is herewith incorporated by reference in its entirety.

BACKGROUND OF THE INVENTION

Field of the Invention

The present invention relates to a hearing device with reduced acoustic wind sensitivity.

Hearing devices are used to supply hearing-impaired persons with acoustic ambient signals which are processed and amplified to compensate for and/or treat the respective hearing impairment. A hearing device includes in principle one or more input converters, a signal processing facility with an amplification facility and/or an amplifier and an output converter. The input converter is generally a receiving transducer, e.g. a microphone and/or an electromagnetic receiver, such as an induction coil. The output converter is generally implemented as an electroacoustic converter, e.g. miniature loudspeaker, or as an electromechanical converter, such as a bone conduction receiver. It is also referred to as a receiver. The output converter generates output signals, which are routed to the ear of the patient and generate an audio perception in the case of the patient. The amplifier is generally integrated into the signal processing facility. The power supply to the hearing device takes place by means of a battery arranged in the hearing device housing. The essential electronic components of a hearing device are generally arranged on a printed circuit board as an interconnect device or are connected thereto.

Hearing devices are known in various basic housing configurations. With ITE hearing devices (In-The-Ear) a housing which contains all the functional components including a microphone and a receiver, is for the most part worn in the auditory canal. CIC hearing devices (Completely-In-Canal) are similar to the ITE hearing devices, but are however worn completely in the auditory canal. With BTE hearing devices, (Behind-The-Ear) a housing with components such as a battery and signal processing facility is worn behind the ear and a flexible acoustic tube, also referred to as tube, guides the acoustic output signals of a receiver from the housing to the auditory canal. RIC-BTE hearing devices (Receiver-In-Canal Behind-The-Ear) equate to the BTE hearing devices, but the receiver is worn in the auditory canal and instead of an acoustic tube, which routes acoustic signals to an earpiece, a flexible cable or a wire-carrying tube, also referred to as receiver tube or receiver connecting means, guides electrical signals to a receiver which is attached to the front of the receiver tube.

In addition to optical properties, such as a small installation size or an agreeable shape, the acoustic properties determine the quality of a hearing device. The acoustic properties are significantly benefited by means of the high quality input converter, output converter and a good signal processing facility. A further determining factor is the sensitivity to wind. Wind which blows across the hearing device and/or forms due to movement of the hearing device wearer, often results in interference noises which are amplified again by the hearing device and disturb the hearing device wearer in terms of his/her hearing perception and possibly hamper understanding of the spoken language for instance. A favorable embodiment and position of the microphone openings relative to the head and auricle of the hearing device wearer or covers on the hearing device housing form part of the known countermeasures. Furthermore, electronic measures, such as filtering or reducing the amplification factor, enable the influence of wind noises to be reduced. Inspite of these measures, there still exists the need to reduce the acoustic wind sensitivity of hearing devices further or by way of alternative solutions.

SUMMARY OF THE INVENTION

It is accordingly an object of the invention to provide a hearing device which overcomes the above-mentioned disadvantages of the heretofore-known devices and methods of this general type and which provides for a hearing device with reduced acoustic wind sensitivity.

With the foregoing and other objects in view there is provided, in accordance with the invention, a hearing device, comprising: functional parts of a hearing device; and a surface formed with a shark skin structure.

One significant reason for the occurrence of interference or wind noises if wind blows over the surface of a hearing device is that as of a specific wind speed, e.g. measured in meters per second, a laminar flow passes into a turbulent flow. This process can also be described such that a fluid flows in layers which do not mix and the fluid is increasingly disturbed by turbulences, i.e. swirling or transverse flows as of a specific flow speed. Turbulences can be detected in a wind tunnel for instance. If this swirling appears in the region of the microphones and/or the microphone inlet openings of a hearing device, they produce noise which can be perceived as bothersome by a hearing device wearer, or the one possible wanted signal, i.e. speech, is overlayed and the perception of the wanted signal is negatively influenced. The occurrence of turbulences can be identified using measuring technology for instance by a deterioration of the signal-to-noise ratio, whereby the ratio of wanted signal to noise signal decreases more significantly from a characteristic wind speed, for instance by an order of magnitude, than with wind speeds which are lower than the characteristic wind speed, subsequently also referred to as the characteristic wind speed or limiting wind speed. The object of the invention of specifying a hearing device with reduced acoustic wind sensitivity can therefore also be described such that the critical wind speeds are to be moved toward higher speeds.

The basic idea behind the invention is a hearing device, the surface of which includes a shark skin structure. The skin of a shark consists of thousands of small scales with recesses and elevations. The sharp and pointed shapes of the scales form small channels in the direction of swimming movement of the shark. Dividing the water flow into the smallest regions prevents water particles of the water flow from connecting, forming swirls and then also disturbing the surround water flow. This principle can also be applied to air as a surrounding medium. The technical implementation of the principle of operation of shark skin and the principle realizability of such structures is known from the prior art, for example, from Fraunhofer Mediendienst, special edition 05-2010, issue 4 "Shark skin for airplanes, ships and wind power systems", published by Fraunhofer Gesellschaft, Munich, Germany. There, the use in these fields of application substantially aims at a reduction in the water and/or air resistance. Further details and differences when using shark skin structures in hearing devices are described below.

The shark skin structure of a surface of a hearing device preferably includes scales, which have a length between 0.1 μm and 0.1 mm and a height which is less than the length.

The dimensions of the scales, from which the shark skin structure is composed, influence the wind speed from which a laminar wind flow changes into a turbulent flow. The specified region represents a preferred size range.

In accordance with the invention, the scales have channel-type recesses and rib-type elevations, which are parallel to one another and define a longitudinal axis.

Furthermore, in accordance with the invention, when the hearing device is being worn, at least directional components of the longitudinal axis of the scales are aligned parallel to an axis, which is defined by the straight line of sight of a hearing device wearer.

The best effect in terms of increasing the critical wind speed is generally then achieved if the longitudinal axis of the scales is parallel to the vector of the wind speed. In the event of a hearing device which is worn behind the ear of a hearing device wearer, wind, e.g. when walking, will blow past the hearing device predominantly in parallel with the auricle, i.e. in the straight line of sight of a hearing device wearer, so that an alignment of the longitudinal axis of the scales parallel to the straight line of sight of the hearing device wearer is advantageous. Since on account of the curved surface of a hearing device, not all longitudinal axes of the scales can be aligned in the straight line of sight of the hearing device wearer, at least one component is to be aligned in this direction.

The surface with the shark skin structure preferably only includes points which are not in contact with the skin of the hearing device housing when the hearing device is being worn.

The shark skin structure with its elevations and channels could bring about an unpleasant wearing sensation if it rests on the skin of a hearing device wearer. To prevent this, the shark skin structure should only include points which are not in direct skin contact. Such points are for instance on the upper side of the hearing device housing or on the upper side of a hearing device hook.

The scales are favorably embedded in a varnish. A varnish in which small scales with the described properties are embedded, enable the shark skin structure to be attached to curved surfaces.

It is conceivable that the shark skin structure is embodied on the surface of a film.

This method is advantageous in that the shark skin structure can be applied to the hearing device with simple means, for example by means of adhesion.

It is particularly advantageous that the shark skin structure is impressed into the in particular glass fiber-reinforced, surface of the hearing device.

Modern injection molding methods enable textures in the micrometer range, with which hearing device housings with a shark skin structure can be cost-effectively produced for instance with high quality. Further methods of impressing a shark skin structure into a hearing device housing or a hearing device hook are high-precision laser drilling methods. A hard or hardened surface lends itself to a stable surface structure, such as can be achieved for instance by means of glass fiber reinforcement.

A preferred embodiment of the invention provides that the material which embodies the shark skin structure is biocompatible.

In this context, the term biocompatible is to be understood to mean that the material which embodies the shark skin structure does not have a negative influence on the hearing device wearer, in particular does not irritate the skin of the hearing device wearer chemically. A biotolerant material is suitable for the purpose, and a bioinert material is preferred.

Other features which are considered as characteristic for the invention are set forth in the appended claims.

Although the invention is illustrated and described herein as embodied in a hearing device with reduced acoustic wind sensitivity, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
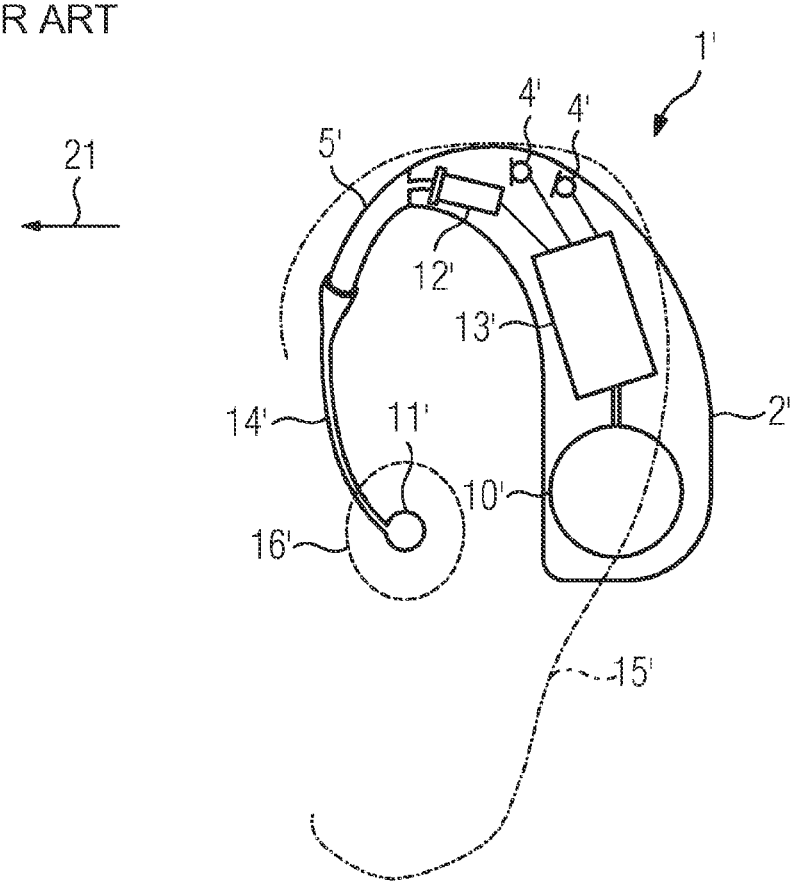
FIG. 1 PRIOR ART
FIG. 1 shows a schematic representation of a hearing device according to the prior art.

Referring now to the figures of the drawing in detail and first, particularly, to FIG. 1 thereof, there is shown a schematic representation of a behind-the-ear hearing device 1' according to the prior art. The device has several functional parts, including a housing 2' to be worn behind the auricle 15' of a hearing device wearer. Aside from electronic components which are combined to form a signal processing unit 13', two microphones with the microphone openings 4', a battery 10' and a receiver 12' are arranged in the housing 2'. The acoustic signal generated by the receiver 12' is guided through a hearing device hook 5' and an acoustic tube 14' to an earpiece 11', which is inserted into an auditory canal 16' of the hearing device wearer. When the hearing device is being worn, the straight line of sight of the hearing device wearer defines an axis 21, whereby the line of sight in FIG. 1 is also specified by an arrow.

Figure 2:
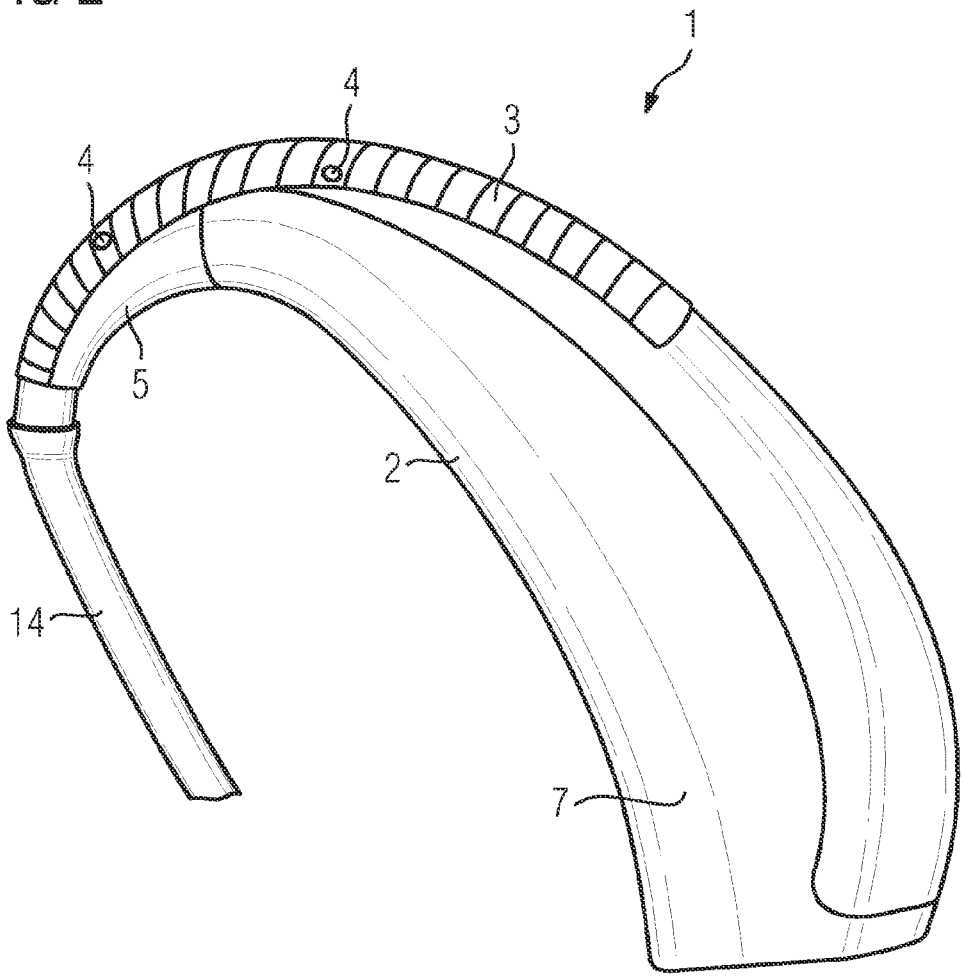
FIG. 2 shows exemplary parts of a hearing device having possible layers of the surfaces with a shark skin structure.

FIG. 2 shows important parts of an inventive hearing device 1 by way of example. It shows a hearing device housing 2 with a hearing device housing surface 7, a hearing device hook 5, two microphone inlet openings 4 and a part of an acoustic tube 14. Points 3 of the hearing device 1 which preferably comprise a shark skin structure are points which are exposed to wind, i.e. points on the hearing device housing surface 6 and on the hearing device hook 5, in particular in the immediate vicinity of the microphone inlet openings 4 for instance.

Figure 3:
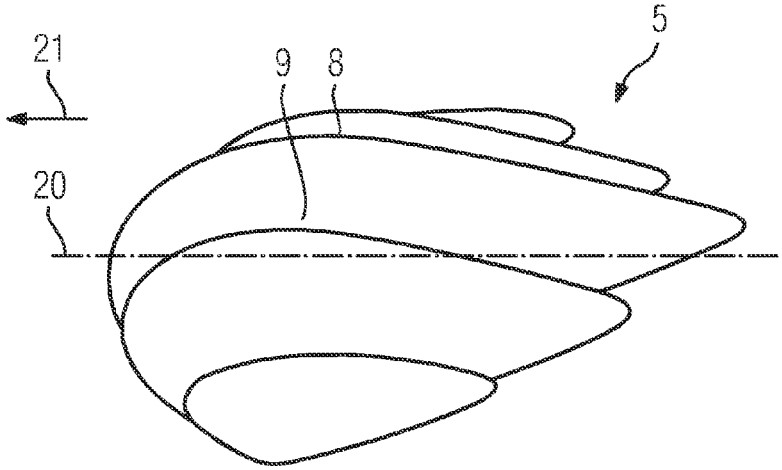
FIG. 3 shows an exemplary embodiment of a scale of a shark skin structure.

FIG. 3 shows an exemplary embodiment of a scale 5 of a shark skin structure. It includes channel-type recesses 9 and rib-type elevations 8, which are parallel to one another and define a longitudinal axis 20. In a shark skin structure of a hearing device, at least components of the longitudinal axis 20 are preferably aligned parallel to an axis 21 which is defined by a straight line of sight of a hearing device wearer, whereby in FIG. 2 the light of sight is additionally specified by an arrow.

Figure 4:
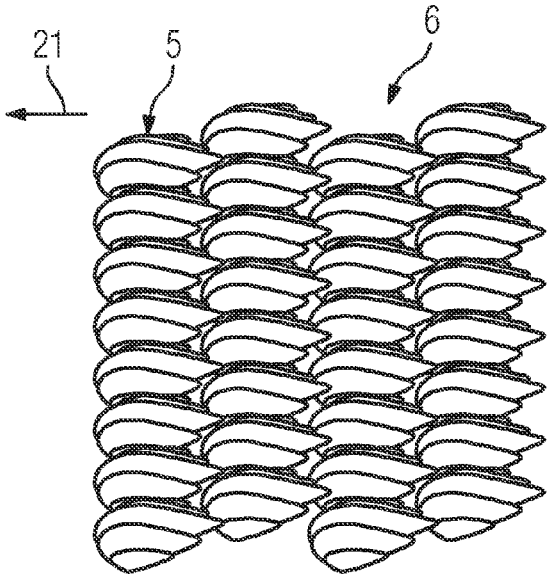
FIG. 4 shows an exemplary embodiment of a shark skin structure.

FIG. 4 shows an exemplary combination 6 of several scales 5 forming a shark skin structure. The scales 5 are preferably arranged offset relative to one another and overlap. Arrangements in which there is no overlap are likewise conceivable.

Figure 5:
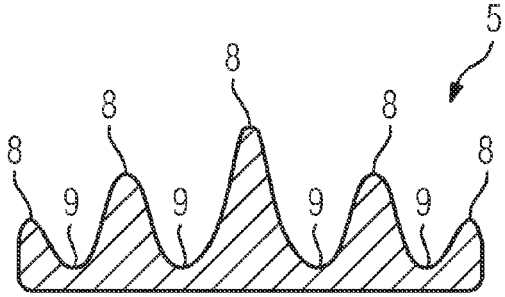
FIG. 5 shows an exemplary embodiment of a cross-section of a scale of a shark skin structure.

FIG. 5 finally shows by way of example a cross-section of an exemplary embodiment of a scale 5. The channel-type recesses 9 and rib-type elevations 8, which divide an air flow tending toward turbulences into smaller air flows and thus adjust the formation of swirls and turbulences to form higher wind speeds, are essential. The height of the elevations and the depth of the recesses in FIG. 5 are understood as an example. Exemplary embodiments with the same height of elevations, elevations which are higher in the border area than in the middle of the scale, exemplary embodiments with different levels of recesses are likewise possible.

The invention claimed is:

1. A Behind-The-Ear hearing aid, comprising: functional parts of a hearing aid selected from the group consisting of at least one microphone, an input converter, a signal processor, and an output converter disposed in a housing with a surface, said surface of said housing having a microphone opening formed therein; and said surface being formed with a shark skin structure said shark skin structure including scales having a length between 0.1 μm and 0.1 mm and having a height that is less than the length, said scales including channel-shaped recesses and rib-shaped elevations extending parallel to one another and defining a longitudinal axis substantially in forward-looking alignment of the hearing aid when the hearing aid is being worn.

2. The Behind-The-Ear hearing aid according to claim 1, wherein, when the hearing aid is being worn by a hearing aid wearer, directional components of the longitudinal axis of said scales are aligned parallel with an axis defined by a straight line of sight of the hearing device wearer.

3. The Behind-The-Ear hearing aid according to claim 1, wherein, when the hearing aid is being worn by a hearing aid wearer, the longitudinal axis of said scales extends parallel with an axis defined by a straight line of sight of the hearing device wearer.

4. The Behind-The-Ear hearing aid according to claim 1, wherein said surface with said shark skin structure only includes surface points that are not in contact with the skin of a hearing aid wearer when the hearing aid is being worn.

5. The Behind-The-Ear hearing aid according to claim 1, wherein said scales are embedded in a varnish.

6. The Behind-The-Ear hearing aid according to claim 1, wherein said shark skin structure is embodied on a surface of a film or foil.

7. The Behind-The-Ear hearing aid according to claim 1, wherein said shark skin structure is impressed into the surface of the hearing aid.

8. The Behind-The-Ear hearing aid according to claim 7, wherein said surface of the hearing aid is formed of a glass fiber-reinforced wall of a housing of the hearing aid.

9. The Behind-The-Ear hearing aid according to claim 1, wherein a material embodying said shark skin structure is biocompatible.

* * * * *